United States Patent [19]

MacKinnon

[11] 4,206,067

[45] Jun. 3, 1980

[54] THERMALLY STABILIZED EROSION-INHIBITED FUNCTIONAL FLUIDS CONTAINING PERHALOMETAL COMPOUNDS AND AN ORGANIC BASE

[75] Inventor: Hugh S. MacKinnon, Oakland, Calif.

[73] Assignee: Chevron Research Company, San Francisco, Calif.

[21] Appl. No.: 947,796

[22] Filed: Oct. 2, 1978

[51] Int. Cl.[2] ..... C10M 3/26; C10M 3/02

[52] U.S. Cl. ..... 252/75; 252/74; 252/77

[58] Field of Search ..... 252/75, 77, 78.5, 74, 252/78.3

[56] References Cited

U.S. PATENT DOCUMENTS

| | | | |
|---|---|---|---|
| 3,377,288 | 4/1968 | Sawyer | 252/77 X |
| 3,592,772 | 7/1971 | Godfrey et al. | 252/75 |
| 3,790,487 | 2/1974 | Burrous | 252/77 X |
| 3,795,621 | 3/1974 | Sheratte | 252/78.5 |
| 3,907,697 | 9/1975 | Burrous | 252/75 |

*Primary Examiner*—Harris A. Pitlick

*Attorney, Agent, or Firm*—D. A. Newell; S. R. LaPaglia; J. J. DeYoung

[57] ABSTRACT

The addition of an organic base to a functional fluid containing a perhalometallic or perhalometalloidic salt maintains the pH of the fluid greater than 7 and thereby stabilizes the antierosion properties of the fluid.

12 Claims, No Drawings

THERMALLY STABILIZED EROSION-INHIBITED FUNCTIONAL FLUIDS CONTAINING PERHALOMETAL COMPOUNDS AND AN ORGANIC BASE

BACKGROUND OF THE INVENTION

1. Field of the Invention

This invention relates to fluid compositions which are useful in transmitting power in hydraulic systems. Specifically, it relates to power transmission fluids having a tendency to cause erosion of hydraulic systems and a newly discovered means of increasing the stability of functional fluids exposed to heat.

Organic phosphate ester fluids have been recognized for some time as advantageous for use as the power transmission medium in hydraulic systems. Such systems include recoil mechanisms, fluid-drive power transmission, and aircraft hydraulic systems. In the latter, phosphate ester fluids find particular utility because of their special properties which include high viscosity index, low pour point, high lubricity, low toxicity, low density and low flammability. Thus, for some years, numerous types of aircraft, particularly commercial jet aircraft, have used phosphate ester fluids in their hydraulic systems. Other power transmission fluids which have been utilized include major or minor amounts of hydrocarbon oils, amides of phosphoric acid, silicate esters, silicones and polyphenyl ethers. Additives which perform special functions such as viscosity index improvement and foam inhibition are also present in these fluids.

The hydraulic systems of a typical modern aircraft include a fluid reservoir, fluid lines and numerous hydraulic valves which actuate various moving parts of the aircraft such as the wing flaps, ailerons, rudder, and landing gear. In order to function as precise control mechanisms, these valves often contain passages or orifices having clearances on the order of a few thousandths of an inch or less through which the hydraulic fluid must pass. In a number of instances, valve orifices have been found to be substantially eroded by the flow of hydraulic fluid. Erosion increases the size of the passage and reduces below tolerable limits the ability of the valve to serve as a precision control device. Many aircraft have experienced sagging wing flaps during landings and takeoffs as a result of valve erosion.

Early investigations indicated that the erosion was being caused by cavitation in the fluid as the fluid passed at high velocity from the high-pressure to the low-pressure side of the valve. The incorporation of water into the hydraulic fluid was found to inhibit the erosion, but continuing experience shows that a significant erosion problem remains.

Recent studies indicate that certain valve erosions are associated with the electrokinetic streaming current induced by the high-velocity fluid flow. It is believed that some antierosion additives function by controlling the conductivity of the fluid. However, functional fluids are not hydrolytically and/or thermally stable, and after being exposed to heat in the presence of water, fluid conductivity changes fall below acceptable levels.

DESCRIPTION OF THE PRIOR ART

A study of the problem attributing valve erosion to the streaming current induced by fluid flow is Beck et al, "Corrosion of Servovalves by an Electrokinetic Streaming Current", Boeing Scientific Research Document D1-82-0839 (September 1969). Efforts to control hydraulic valve erosion by treating the problem as one of cavitation in the fluid are described in Hampton, "The Problem of Cavitation Erosion in Aircraft Hydraulic Systems", *Aircraft Engineering*, XXXVIII, No. 12 (December 1966). The test, *Organophosphorus Compounds*, by Kosolapoff (Wiley, New York, 1950), describes methods of preparing organophosphorus derivatives. Several patents describe phosphate ester hydraulic fluids, including U.S. Pat. Nos. 2,636,861, 2,636,862, 2,894,911, 2,903,428 and 3,036,012.

U.S. Pat. No. 3,907,697, the entire disclosure of which is incorporated herein by reference, discloses an erosion-inhibited functional fluid. Erosion is inhibited by the addition of a small amount of a soluble salt of perhalometallic or perhalometalloidic acid to the functional fluid.

SUMMARY OF THE INVENTION

In a functional fluid composition comprising a fluid base and containing a soluble perhalometallate or perhalometalloidate salt, the improvement comprising maintaining the pH of said fluid at greater than 7 by the addition of an effective amount of a high-boiling-point organic base which is soluble in said fluid. It has been discovered that these soluble bases stabilize the functional fluid at elevated temperatures.

DETAILED DESCRIPTION OF THE INVENTION

The antierosion functional fluid of the present invention comprises a base fluid, a perhalometallic or perhalometalloidic acid, and a high-boiling organic base. The base fluid and perhalometallic or perhalometalloidic acids are described in U.S. Pat. No. 3,907,697, the entire disclosure of which is incorporated herein by reference.

The functional fluids of the present invention comprise a fluid base present in major proportion in which the halo-containing compounds and other additives are employed. The fluid base includes a wide variety of base materials, such as organic esters of phosphorus acids, mineral oils, synthetic hydrocarbon oils, silicate esters, silicones, carboxylic acid esters, aromatics and aromatic halides, esters of polyhydric material, aromatic esters (such as polyphenyl ether), thioethers, etc.

The phosphate esters are the preferred base fluid of the present invention and have the formula

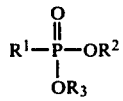

wherein $R^1$, $R^2$ and $R^3$ each represent an alkyl or aryl hydrocarbon group. (As used herein, "aryl" includes aryl, alkaryl, and aralkyl structures and "alkyl" includes aliphatic and alicyclic structures). All three groups may be the same, or all three different, or two groups may be alike and the third different. A typical fluid will contain at least one species of phosphate ester and usually will be a mixture of two or more species of phosphate esters.

In a particularly preferred embodiment, the hydraulic fluid base of this invention consists essentially of a mixture of trialkyl and triaryl phosphate esters with the trialkyl phosphate esters predominating. The trialkyl phosphate esters may be present in amounts of from 70 to 98% by weight of the phosphate ester portion of the total fluid composition. Preferably, the trialkyl phosphate esters will comprise 80 to 92% by weight of the phosphate ester portion of the composition. The trialkyl phosphate esters which give optimum results are those wherein each of the alkyl groups has 1 to 12 carbon atoms and, preferably, has from 4 to 9 carbon atoms. The alkyl groups may each be either a straight-chain or a branched-chain configuration. A single trialkyl phosphate ester may have the same alkyl group in all three positions, or may have two or three different alkyl groups. Mixtures of various trialkyl phosphate esters may also be used. Suitable, but non-limiting species of trialkyl phosphate esters useful in this invention include the tributyl phosphates, particularly tri(n-butyl) phosphate, trihexyl phosphates, and trioctyl phosphates. Particularly preferred are tri(n-butyl) phosphate or the branched-chain isomers of the trioctyl phosphates, such as tri(2-ethylhexyl) phosphate.

The triaryl phosphate esters useful in the composition of this invention may be present in amounts of from about 2 to about 30% by weight of the phosphate ester portion of the total fluid composition. The triaryl phosphate esters which give optimum results are those wherein each of the aryl hydrocarbon groups has between 6 and 15 carbon atoms and, preferably, from 6 to 10 carbon atoms. These include phenyl groups and alkyl-substituted phenyl groups. As with the trialkyl phosphates, a single triaryl phosphate may have the same aryl groups in all three positions, or may have a mixture of two or three different aryl groups. Various mixtures of triaryl phosphates may also be used. Suitable, but non-limiting species of triaryl phosphates include triphenyl phosphate, tricresyl phosphate, diphenylcresyl phosphate, and diphenylxylyl phosphate, diphenyl(ethylphenyl) phosphate, and dicresylphenyl phosphate. Preferred are those triaryl phosphates wherein at least one aryl group is a monoalkyl-substituted aryl group having one or two carbon atoms in the alkyl group, and preferably one carbon atom in the alkyl group.

The mixed phosphate ester portion of the composition of this invention will comprise at least 70% by weight of the total composition, and preferably at least 90% by weight of the total composition.

In another embodiment, the base stock can comprise a mixed alkylaryl phosphate ester such as dibutyl phenyl phosphate, butyl diphenyl phosphate, methyl ethyl phenyl phosphate, etc. Particularly preferred is dibutyl phenyl phosphate.

Perhalometallic Acid and Perhalometalloidic Salts

The terms "perhalometallic acid" and "perhalometalloidic acid" as used herein encompass all of the perhalo acids of the metals and metalloids of the Periodic Table capable of forming the perhalo acids. These acids are sometimes referred to as "super acids". The metals and metalloids which are capable of forming perhalo acids include beryllium of Group II-A, thorium of Group III-B, titanium and zirconium of Group IV-B, niobium and tantalum of Group V-B, chromium of Group VI-B, manganese and rhenium of Group VII-B, iron, nickel, ruthenium, rhodium, palladium, osmium, iridium and platinum of Group VIII, gold of Group I-B, aluminum, gallium and boron of Group III-A, phosphorus, arsenic and antimony of Group V-A and tellurium of Group VI-A. Exemplary perhalometallic acids include hexafluoroaluminic, hexafluoroantimonic, hexafluoroferric, hexafluorotitanic, hexafluorothoric, hexafluorogermanic, hexafluorozirconic, tetrafluoroberyllic, trifluorostannous, hexafluorostannic, hexafluoro- and heptafluorotantalic, hexafluorochromic, hexafluoroniobic, hexafluoromanganic, tetrafluoroboric, hexafluoro- and tetrafluorophosphoric, hexafluorosiliconic, hexafluoroarsenic, hexachloroiridic, hexachloroosmic, tetrachloro- and hexachloropalladic, tetrachloro- and hexachloroplatinic, hexachlorodic, hexaidoplatinic and hexabromoiridic, and hexabromoplatinic acids.

The perhalometallate and perhalometalloidate salts can be prepared by reacting the perhalo acid with a basic compound such as an alkali metal base, an alkaline earth metal base, ammonium bases, substituted ammonium bases, phosphonium bases and substituted phosphonium bases. Other basic compounds may also be employed, provided that the basic compound forms a salt with the perhalo acid and such resulting salt is sufficiently soluble in the functional fluid to effect a reduction in the streaming current of the fluid. Exemplary basic compounds include alkali metal hydroxides, oxides and carbonates such as sodium hydroxide, potassium hydroxide, lithium hydroxide, sodium oxide, potassium oxide, sodium carbonate, sodium bicarbonate, potassium carbonate, potassium bicarbonate, etc., alkaline earth metal hydroxides, oxides and carbonates such as calcium hydroxide, barium hydroxide, calcium oxide, barium oxide, calcium carbonate, calcium bicarbonate, etc. Ammonium hydroxide, substituted quaternary ammonium hydroxides such as tetramethyl ammonium hydroxide, trimethylbenzyl ammonium hydroxide, tetrapropyl ammonium hydroxide, tetrabutyl ammonium hydroxide, etc., phosphonium hydroxide, tetramethyl phosphonium hydroxide, tetrabutyl phosphonium hydroxide, trimethylbenzyl phosphonium hydroxide, etc. Other basic compounds include zinc hydroxide, zinc carbonate, zinc bicarbonate, etc.

The perhalometallate and perhalometalloidate salts may also be prepared by reacting a halogenated metal or metalloid with an ammonium or phosphonium halide or a substituted ammonium or substituted phosphonium halide. Exemplary reactions include a reaction of ammonium fluoride with boron trifluoride, phosphonium fluoride with boron trifluoride, ammonium fluoride with phosphorus pentafluoride, phosphonium chloride with boron trifluoride, tetramethyl ammonium chloride with boron trifluoride, methylbenzyl phosphonium chloride with phosphorus pentafluoride, methylbenzyl phosphonium chloride with boron trichloride, ammonium chloride with antimony pentachloride, triethyl oxonium fluoride with boron trifluoride, triphenyl carbenium chloride with phosphorus pentafluoride, etc.

A preferred class of perhalometallate and perhalometalloidate salts for use in the functional fluid of the present invention are believed to have the following general formual:

$$M[AX_y]_z$$

wherein:

A is a metal or metalloid, and preferably a metalloid;

M is a solubilizing cation;

X is a halogen, preferably chlorine or fluorine and more preferably fluorine;

y is an integer from 3 to 7 and equal to the positive valence of A plus an integer from 1 to 3; and preferably an integer equal to 4 for the metals and metalloids in the second period of the Periodic Table and equal to 6 for the metals and the metalloids in all other periods of the Periodic Table;

z is an integer from 1 to 3 and sufficient to maintain the salt electro-neutral.

In the above formula, A is an amphoteric metal or metalloid of the type described supra and capable of forming perhalo acids. In a preferred embodiment, A is selected from the group consisting of phosphorus, boron and antimony and, more preferably, phosphorus or boron. M can be any stable cation which imparts significant solubility to the salts in the functional fluid. This solubility is preferably from at least 0.01 gram per liter of the perhalo salt in the functional fluid and, more preferably, at least about 0.01 gram/liter. The preferred solubilizing cation includes alkali metal, ammonium, phosphonium, $C_1$–$C_{30}$ hydrocarbyl-substituted ammonium, $C_1$–$C_{30}$ hydrocarbyl-substituted phosphonium cations, $C_3$–$C_{30}$ trihydrocarbyl carbenium, and $C_3$–$C_{30}$ trihydrocarbyl oxonium. The most preferred solubilizing cations are sodium, potassium and ammonium.

Some of the preferred perhalometallates and perhalometalloidates include ammonium hexafluorophosphate ($NH_4PF_6$), N-benzyl-N,N,N-trimethyl ammonium hexafluorophosphate $(CH_3)_3(CH_6H_5CH_2)NPF_6$, potassium hexafluorophosphate, tetrabutyl ammonium hexafluorophosphate, ammonium tetrafluoroborate ($NH_4BF_4$), sodium tetrafluoroborate, zinc tetrafluoroborate, sodium hexafluoroantimonate ($NaSbF_6$), ammonium hexafluoroantimonate, N-benzyl-N,N,N-triethyl phosphonium hexafluorophosphate, potassium hexafluoroantimonate, etc.

Methods of preparation of the various perhalometallates and perhalometalloidates are well known in the chemical literature, and many are commercially available from Ozark-Mahoning of Tulsa, Oklahoma.

The concentration of perhalometallate or perhalometalloidate salt in the functional fluid varies, depending upon the salt selected, operating temperature, etc. Generally, however, from 0.0001 to 2 weight precent, preferably from 0.0005 to 1 weight percent, of the salt is incorporated into the functional fluid, and more preferably from 0.001 to 0.01 weight percent.

Organic Base

Any organic base which is soluble in the base fluid, has a boiling point above 180° C., and maintains the pH of the functional fluid above 7 can be utilized in the present invention.

The organic base should have a boiling point above 180° C. and preferably above 200° C. in order to prevent the base from boiling away at the higher operational temperature of the functional fluid. Preferred organic bases are those having 10 to 100 carbon atoms, and more preferably 15 to 50 carbon atoms.

The concentration of the organic base in the functional fluid varies, depending upon the base selected, operating temperature, etc. The functional fluid must contain a sufficient amount of the organic base to maintain the pH in excess of 7, preferably above 8.0, and most preferably in the range 8.4 to 9.6. Generally, from 0.01 to 1.0 weight percent, preferably from 0.05 to 0.25 weight percent, of the base is incorporated in the functional fluid, and more preferably from 0.10 to 0.20 weight percent.

The preferred organic bases comprise amines and phosphines having from 10 to 100 carbon atoms, preferably 14 to 36 carbon atoms. Only the amines will be described in detail hereinafter, since the applicable phosphines are similar in structure to the amines, that is, one merely substitutes a phosphorus atom for a nitrogen atom. Another preferred class of organic bases are the organo-metallic bases, for example the Group II metal phenates and sulfonates, such as calcium phenates and sulfonates, etc., which are well known in the lubricants art.

Representative amines include tallow amine, which is an N-octadecenyl-1,3-diaminopropane and N-octadecadienyl-1,3-diaminopropane, ditallow amine, dicoco amine, coco amine, dimethyl (hydrogenated tallow) amine, tridodecyl amine and N-tallow-1,3-propylene diamine.

In general, tertiary amines are preferred to secondary amines, which are preferred to primary amines.

A preferred class of amines is the ethoxylated amines, particularly the mono-, di-, tri and tetra-substituted diamines where the substituent is a hydroxyalkyl of 2 to 6 carbon atoms. Representative ethoxylated amines include: N,N,N',N'-tetrakis(2-hydroxypropyl) ethylene diamine, N-tallow-N,N',N'-triethoxy and propylene diamine.

Another preferred class of amines includes the N-substituted alkylimidiazolidines of the following formula:

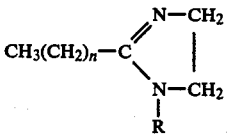

wherein:

R=H, or a low-molecular-weight substituent of 2 to 4 carbon atoms and containing a terminal hydroxy group, and n=2 to 18.

Representative alkylimidiazolidine compounds include: 1-hydroxyethyl-2-coco imidazoline, 1-hydroxyethyl-2-mixed heptadecenyl and heptadecadienyl imidazoline.

Other Additives

The hydraulic fluids of the present invention generally contain a number of additives which in total comprise 5–25 weight percent of the finished fluid. Among these is water, which may be added intentionally or often becomes incorporated into the fluid during the inherent operations of the system. Such incorporation can occur when a hydraulic system is being refilled and is open to the atmosphere, particularly in humid environments. Unintentional incorporation of water may also occur during the manufacturing process of a phosphate fluid. In practice, it is recognized that water will be incorporated into the fluid and steps are taken to control the water content at a level in the range of 0.1–1 weight percent of the whole fluid. It is preferred that the water content be in the range of 0.1–0.8 weight percent, and more preferably 0.1–0.3 weight percent.

It is preferred that the functional fluid of the present invention contain from 10 to 1000 ppm of a metal deactivator. Metal deactivators are well known in the art. Particularly preferred metal deactivators are benzotriazole and quinizarin.

It is also preferred that the functional fluid of the present invention contain an oxidation inhibitor. Any of the well-known oxidation inhibitors can be utilized.

Particularly preferred oxidation inhibitors are the hindered phenols, such as di-t-butylparacresol.

Hydrolysis inhibitors to retard corrosion are often added to hydraulic fluids. They include various epoxides such as the glycidyl ethers described in U.S. Pat. No. 2,636,861. Typical epoxide compounds which may be used include glycidyl methyl ether, glycidyl isopropyl ether, styrene oxide, and epichlorohydrin. Hydrocarbon sulfides, especially hydrocarbon disulfides such as dialkyl disulfide, are often used in combination with the epoxide compounds for additional corrosion suppression. Typical hydrocarbon disulfides include dibenzyl disulfide, dibutyl disulfide and diisoamyl disulfide. A particularly preferred class of epoxide hydrolysis inhibitors are those containing two linked cyclohexane groups to each of which is fused an epoxide (oxirane) group. Examples of such compounds include 3,4-epoxycyclohexylmethyl-3,4-epoxycyclohexane carboxylate (marketed by Union Carbide under the brand name ERL-4221), bis(3,4-epoxy-6-methylcyclohexylmethyl adipate, 2(3,4-epoxycyclohexyl)-5,5-spiro(3,4-eposy)cyclohexane-m-dioxane (marked by Union Carbide under the brand name ERL-4234).

A particularly preferred diepoxide which may be employed in the practice of this invention comprises 0.1–1.5% by weight of the total composition of a diepoxide having the following generalized formula:

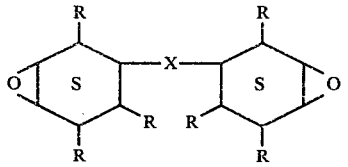

wherein x is a divalent organo-radical containing 1 to 10 carbon atoms, from 0 to 6 oxygen atoms and from 0 to 6 nitrogen atoms; and R is the same or different constituent selected from hydrogen or lower aliphatic radicals. As defined herein, "lower aliphatic" refers to those aliphatic radicals containing 1 to 5 carbon atoms. In a preferred embodiment, R is hydrogen. In another preferred embodiment, two of the six R groups are methyl radicals and the other four are hydrogen.

The X radical is preferably a divalent (1) carboxylate group, (2) a dioxane group, (3) an amine group, (4) an amide group, or (5) an alkoxy group, or combinations thereof.

The major operative type of structure contained in the diepoxides is the fused-ring epoxide group, of which there are preferably at least two in the molecule. Each "fused-ring epoxide group" consists of an oxirane oxygen attached to two adjacent carbon atoms in a cyclohexane or substituted cyclohexane ring.

In order to serve their inhibitory function, the fused-ring epoxide groups should preferably be present in a minor but significant amount. This amount is essentially independent of the nature of the radical R and may conveniently be measured as "oxirane oxygen" content of the total fluid composition. Oxirane oxygen content should preferably be in the range of from about 0.05 to about 1.5% by weight of the total composition.

The hydraulic fluid normally contains 2–10 weight percent, preferably 5–10 weight percent, of one or more viscosity index improving agents such as alkyl styrene polymers, polymerized organic silicones, or preferably polyisobutylene, or the polymerized alkyl esters of the acrylic acid series, particularly acrylic and methacrylic acid esters. These polymeric materials generally have a number average molecular weight of from about 5000 to 300,000.

EXAMPLES

The following examples illustrate the ability of the above-described organic bases in maintaining the conductivity of a functional fluid at elevated temperatures. Conductivities in excess of $0.3\times10^{-6}$ mho/cm are considered satisfactory with conductivities in the range 0.3 to $1.3\times10^{-6}$ mho/cm being preferred. The hydraulic fluid referred to hereinafter comprises about 72.5 weight percent tributyl phosphate, 11.8 weight percent tri(isopropylphenyl) phosphate, 12.4 weight percent of a polyacrylate viscosity improver, 2.3 weight percent of 3,4-epoxycyclohexylmethyl-3,4-epoxy cyclohexane carboxylate, 0.5 weight percent dibutyl paracresol, 0.5 weight percent di(octylphenyl) amine, 100–110 ppm $NH_4PF_6$ and trace amounts of a foam inhibitor and a dye.

In the following examples the organic base was blended with the hydraulic fluid, placed in a container and heated in an oven to 225° F. Periodically the sample was removed from the oven and the conductivity was measured after the sample had cooled to room temperature. The results are listed below in Table I.

| Base | Wt.% | Time (hrs) | Conductivity (mho/cm) ($10^{-6}$) |
|---|---|---|---|
| Duomeen T[1] | 0.10 | 0 | 1.29 |
| | 0.10 | 496 | 0.68 |
| Ethoduomeen[2] T-13 | 0.10 | 0 | 1.27 |
| | 0.10 | 496 | 0.69 |
| Quadrol[3] | 0.005 | 0 | 1.2 |
| | 0.005 | 498 | 0.55 |
| | 0.10 | 0 | 1.14 |
| | 0.10 | 498 | 0.74 |
| Calcium phenate (4.5% Ca) | 0.05 | 0 | 1.64 |
| | 0.05 | 504 | 0.68 |
| | 0.25 | 0 | 1.38 |
| | 0.25 | >500 | 0.75 |
| $(C_{12})_3N$ | 0.20 | 0 | 1.1 |
| | 0.20 | 200 | 0.25 |
| Unamine C[4,8] | 0.15 | 0 | 0.89 |
| | 0.15 | 264 | 0.52 |
| | 0.25 | 0 | 0.82 |
| | 0.25 | 264 | 0.22 |
| Unamine T[5,8] | 0.25 | 0 | 0.87 |
| | 0.10 | 264 | 0.61 |
| Armeen DMT[6] | 0.10 | 0 | 1.05 |
| | 0.10 | 530 | 0.75 |
| Duomeen L-11[7] | 0.10 | 0 | 1.0 |
| | 0.10 | 504 | 0.71 |

[1] $CH_{18}H_{37}NH(CH_2)_3NH_2$

[2] $C_{18}H_{37}-\underset{\underset{CH_2}{|}}{N}-CH_2CH_2CH_2-N(CH_2CH_2OH)_2)$

[3] N,N,N',N'-tetrakis (2-hydroxypropyl) ethylene diamine

[4] 1-hydroxyethyl-2-coco-imidazoline

[5] 1-hydroxyethyl mixed heptadeceny! & heptadecadienyl imidazole

[6] $N(C_{12}H_{25})_3$

[7] $CH_3(CH_2)_nC(CH_3)N(CH_2)_3NH_2$, n is 10 to 15

[8] Oven temperature at 250° C.

The above data illustrate that without an organic base additive, the conductivity of the hydraulic fluid rapidly falls below the desired $0.3\times10^{-6}$ mho/cm minimum, while with the addition of a small amount of the organic base of the present invention the conductivity is still above the minimum level after 200 to 500 hours.

What is claimed is:

1. In a functional fluid composition comprising a fluid base and containing from 0.0001 to 2% by weight of a soluble perhalometallate or perhalometalloidate salt, the improvement comprising maintaining the conductivity of said fluid above $0.3\times10^{-6}$ mho/cm by the addition of an effective amount of a high-boiling-point organic base which is soluble in said fluid.

2. The functional fluid of claim 1 wherein said fluid base comprises an ester or amide of a phosphorus acid, a hydrocarbon oil, a silicate ester, and a silicone or a polyphenyl ether.

3. The functional fluid of claim 2 wherein said organic base has a boiling point greater than 180° C.

4. The functional fluid of claim 3 wherein from 0.01 to 1.0% by weight of said functional fluid is said organic base.

5. The functional fluid of claim 4 wherein said organic base is an amine containing 10 to 100 carbon atoms.

6. The functional fluid of claim 5 wherein said amine is a tertiary amine.

7. The functional fluid of claim 5 wherein said amine is an ethoxylated amine.

8. The functional fluid of claim 5 wherein said amine is an N-substituted alkylimidazolidine of the formula:

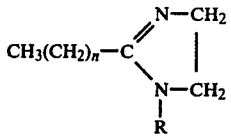

where R is H, or a low-molecular-weight substituent containing 2 to 4 carbon atoms and a terminal hydroxy group and n is 2 to 10.

9. The functional fluid of claim 5 wherein said fluid contains a metal deactivator.

10. The functional fluid of claim 4 wherein said organic base is a phosphine containing 10 to 100 carbon atoms.

11. The functional fluid of claim 4 wherein said organic base is an organo-metallic base.

12. The functional fluid of claim 3 wherein said organic base is an organo-metallic base.

* * * * *